US006224825B1

(12) United States Patent
Leppänen

(10) Patent No.: US 6,224,825 B1
(45) **Date of Patent: *May 1, 2001**

(54) CASE HARDENING STEEL

(75) Inventor: Rainer R. Leppänen, Hällefors (SE)

(73) Assignee: Ovako Steel AB, Hallefors (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/069,176

(22) Filed: Apr. 29, 1998

(51) Int. Cl.[7] ..... C22C 38/54; C22C 38/50
(52) U.S. Cl. ..... 420/106; 420/109
(58) Field of Search ..... 420/106, 109

(56) References Cited

U.S. PATENT DOCUMENTS 3,615,370 * 10/1971 Ridall et al. ..... 420/106
3,664,830 * 5/1972 Kambayashi et al. ..... 420/106
5,536,335 7/1996 Burris .

FOREIGN PATENT DOCUMENTS 46-29256 * 8/1971 (JP) ..... 420/106
02 170944 7/1990 (JP) .
03 028347 2/1991 (JP) .
07 179990 7/1995 (JP) .
09 053150 2/1997 (JP) .

* cited by examiner

*Primary Examiner*—Deborah Yee
(74) *Attorney, Agent, or Firm*—Burns, Doane, Swecker & Mathis, L.L.P.

(57) ABSTRACT

A case hardening steel with a minimum of grain boundary oxidation, suitable for use in the manufacture of mechanical elements with high demands on fatigue resistance and wear resistance, comprising, in % by weight:

| | |
|---|---|
| C | 0.12–0.25 |
| Si | ≦0.30 |
| Mn | 0.30–0.80 |
| Cr | 0.30–0.80 |
| Ni | 0.20–0.80 |
| Mo | 0.10–0.50 |
| Ti | 0.020–0.080 |
| Al | 0.005–0.10 |
| B | 0.001–0.006 |

remainder Fe+normal impurities.

3 Claims, 2 Drawing Sheets

20NiCrMo6-4
grain boundary oxidation 10 μm

20MnCr5
grain boundary oxidation 15 μm

Acc. to the invention
grain boundary oxidation 4 μm

CASE HARDENING STEEL

BACKGROUND OF THE INVENTION

The present invention relates to a case hardening steel with a minimum of grain boundary oxidation, which is suitable for use in the manufacture of mechanical components with high demands on fatigue resistance and wear resistance.

In, for example, gear transmissions, the movable parts are exposed to heavy stresses. In order to obtain a stronger material, the steel is alloyed. It has been found that among other alloying elements, Si, Mn and Cr are deleterious in increasing the depth of grain boundary oxidation. The content of those substances that can be increased first-hand in order to improve this effect are Ni and Mo, but they are very expensive.

OBJECTS AND SUMMARY OF THE INVENTION

It is an object of this invention to avoid or alleviate the problems of the prior art.

It is further an object of this invention to provide a case hardening steel with a minimum of grain boundary oxidation which is suitable for use in the manufacture of mechanical components with high demands on fatigue resistance and wear resistance.

It is an aspect of the invention to improve the internal oxidation properties in case hardening steel compared to conventional steels by decreasing the internal grain boundary oxidation.

Another object of the invention is to reduce the demand of expensive alloying components such as Ni and Mo and still obtain very low values of oxidation depth compared to conventional steels.

This is obtained with the steel according to the presently claimed invention, having the following composition, in % by weight:

| | |
|---|---|
| C | 0.12–0.25 |
| Si | ≦0.30 |
| Mn | 0.30–0.80 |
| Cr | 0.30–0.80 |
| Ni | 0.20–0.80 |
| Mo | 0.10–0.50 |
| Ti | 0.020–0.080 |
| Al | 0.005–0.10 |
| B | 0.001–0.006 |

remainder Fe+normal impurities.

DETAILED DESCRIPTION OF THE PREFERRED EMBODIMENTS OF THE INVENTION

Instead of high contents of the expensive alloying elements Ni and Mo which are favorable for reducing internal oxidation, the steel according to the presently claimed invention comprises small concentrations of B. Further, the contents of the alloying elements Si, Mn and Cr, which are unfavorable for the internal oxidation, are kept at a low level. The steel according to the invention has a good hardening capacity and a minimized grain boundary oxidation (internal oxidation).

This is obtained with the steel according to the presently claimed invention, having the following composition, in % by weight:

| | |
|---|---|
| C | 0.12–0.25 |
| Si | ≦0.30 |
| Mn | 0.30–0.80 |
| Cr | 0.30–0.80 |
| Ni | 0.20–0.80 |
| Mo | 0.10–0.50 |
| Ti | 0.020–0.080 |
| Al | 0.005–0.10 |
| B | 0.001–0.006 |

remainder Fe+normal impurities.

According to a preferred embodiment of the presently claimed invention, the steel has the following composition, in % by weight:

| | |
|---|---|
| C | 0.15–0.22 |
| Si | ≦0.15 |
| Mn | 0.40–0.70 |
| Cr | 0.40–0.70 |
| Ni | 0.30–0.60 |
| Mo | 0.25–0.40 |
| Ti | 0.030–0.070 |
| Al | 0.03–0.06 |
| B | 0.002–0.004 |

remainder Fe+normal impurities.

The internal oxidation has a negative effect on the fatigue properties, depending on weakened grain boundaries, unfavorable structure, reduced surface hardness, unfavorable stresses.

The invention is illustrated more in detail with the following Example by comparisons performed between the resistance against internal oxidation for conventional steel and steel according to the invention. This Example is to be considered illustrative of the present invention. It should be understood, however, that the invention is not limited to the specific details of the Example.

EXAMPLE

In Table 1 below, the composition for two conventional steels and a steel according to the invention are given, expressed in % by weight:

TABLE 1

| Material | C | Mn | Cr | Ni | Al | Ti | B |
|---|---|---|---|---|---|---|---|
| 20NiCrMo6-4 | 0.19 | 0.58 | 0.79 | 1.65 | 0.036 | 0.001 | — |
| 20MnCr5 | 0.18 | 1.28 | 1.13 | 0.10 | 0.036 | 0.001 | — |
| According to the invention | 0.22 | 0.55 | 0.54 | 0.49 | 0.029 | 0.042 | 0.003 |

Table 2 below shows the hardening capacity for the steels disclosed in Table 1.

TABLE 2

| Material | J5-value | J10-value |
|---|---|---|
| 20NiCrMo6-4 | 44 | 40 |
| 20MnCr5 | 41 | 33 |
| According to the invention | 45 | 43 |

Figure 1:
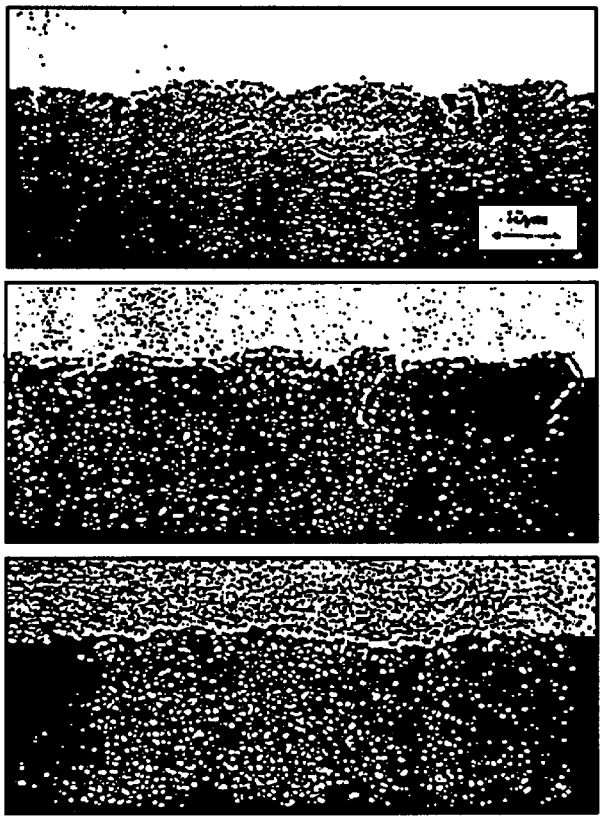
FIG. 1 shows grain boundary oxidation for two previously known steels and the steel according to the invention.

In FIG. 1, the grain boundary oxidation for case hardened specimens of a material according to Table 1 is shown, which clearly shows the improvement which is obtained with the material according to the presently claimed invention. The duration of the carburization was 8 hours, 30 minutes.

Figure 2:
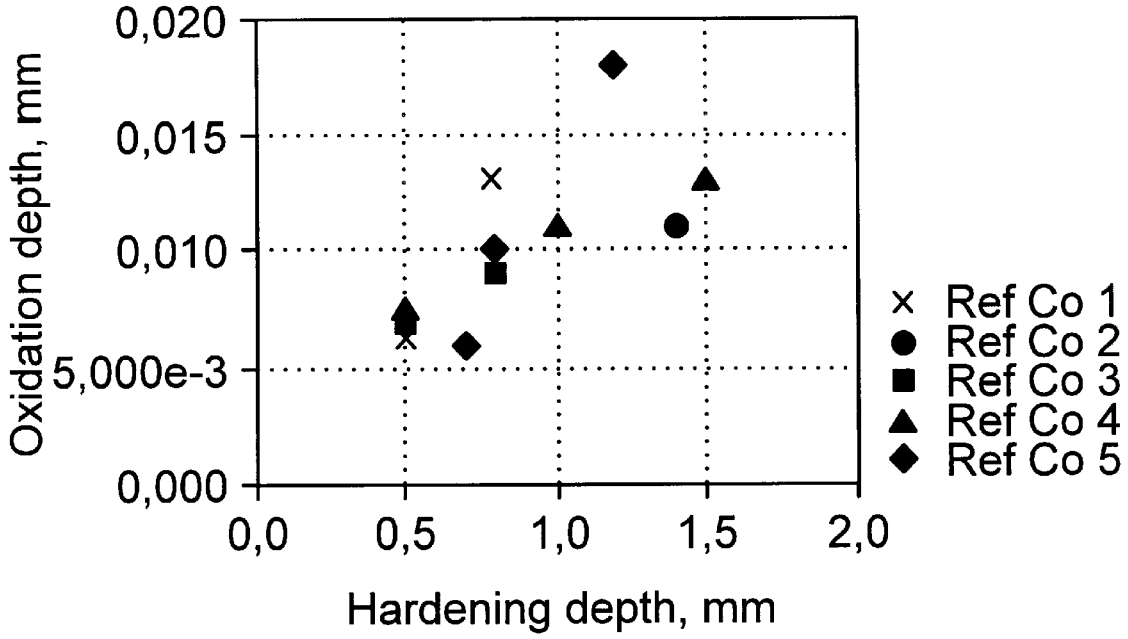
FIG. 2 shows oxidation depth compared to hardening depth for the steel 20 MnCr5.
Figure 3:
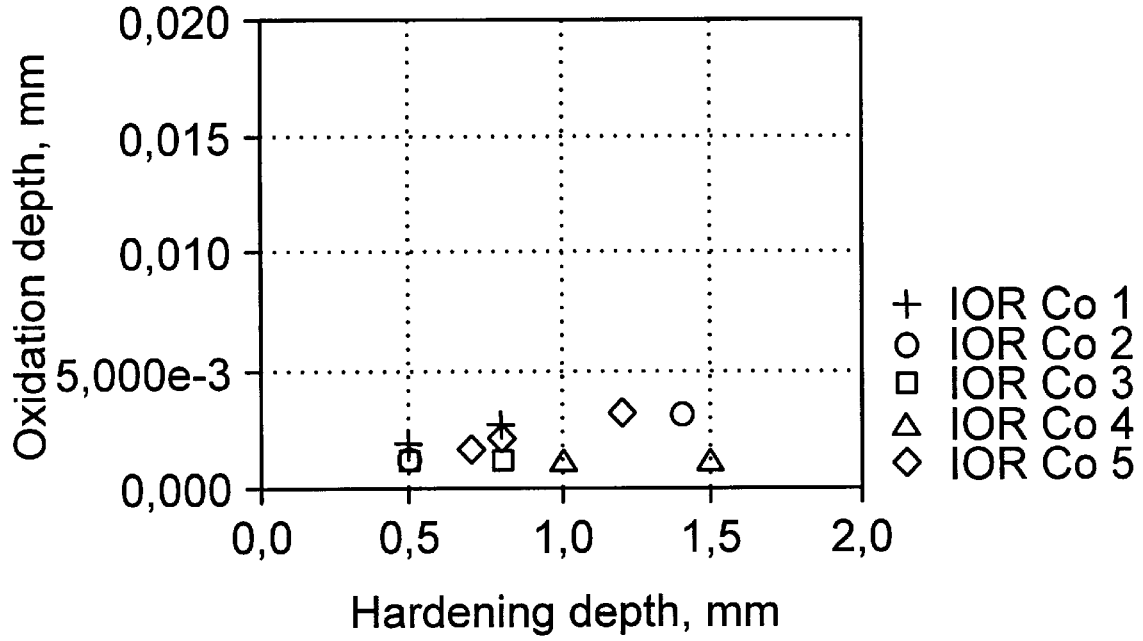
FIG. 3 shows oxidation depth compared to hardening depth for the steel according to the invention.

In FIG. 2, a graph is shown with the internal oxidation versus case hardening depth for the reference material 20 MnCr5, and in FIG. 3, a corresponding graph for the material according to the presently claimed invention is shown. As is evident from the disclosed results, the oxidation depth for the reference material is in the order of 0.010 mm, while for the material according to the presently claimed invention, the depth is in the order of 0.003 mm or smaller.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A case hardening steel with minimized grain boundary oxidation, suitable for use in the manufacture of mechanical elements with high demands on fatigue resistance and wear resistance, consisting essentially of, in % by weight:

| | |
|---|---|
| C | 0.12–0.25 |
| Si | ≦0.30 |
| Mn | 0.30–0.80 |
| Cr | 0.30–0.80 |
| Ni | 0.20–0.80 |
| Mo | 0.10–0.50 |
| Ti | 0.020–0.080 |
| Al | 0.005–0.10 |
| B | 0.001–0.006 |

remainder Fe+normal impurities.

2. The steel of claim 1, comprising, in % by weight:

| | |
|---|---|
| C | 0.15–0.22 |
| Si | ≦0.15 |
| Mn | 0.40–0.70 |
| Cr | 0.40–0.70 |
| Ni | 0.30–0.60 |
| Mo | 0.25–0.40 |
| Ti | 0.030–0.070 |
| Al | 0.03-0.06 |
| B | 0.002–0.004 |

remainder Fe+normal impurities.

3. The steel of claim 1, wherein said steel exhibits an oxidation depth no greater than approximately 0.003 mm.

* * * * *